US007547836B2

(12) United States Patent
Reed

(10) Patent No.: US 7,547,836 B2
(45) Date of Patent: Jun. 16, 2009

(54) MUSICAL DRUM

(76) Inventor: Kevin Matthew Reed, 1254 Hadcock Rd., Brunswick, OH (US) 44212

( * ) Notice: Subject to any disclaimer, the term of this patent is extended or adjusted under 35 U.S.C. 154(b) by 1418 days.

(21) Appl. No.: 10/191,776

(22) Filed: Jul. 9, 2002

(65) Prior Publication Data

US 2003/0029302 A1 Feb. 13, 2003

Related U.S. Application Data

(60) Provisional application No. 60/303,835, filed on Jul. 9, 2001.

(51) Int. Cl.
*G10D 13/02* (2006.01)

(52) U.S. Cl. ..... 84/411 R; 84/420

(58) Field of Classification Search ..... 84/411 R, 84/413, 414, 420, 411 A, 421
See application file for complete search history.

(56) References Cited

U.S. PATENT DOCUMENTS 4,126,075 A * 11/1978 Kurosaki ..... 84/421
5,095,796 A * 3/1992 Genna ..... 84/414
5,329,838 A * 7/1994 Yamashita ..... 84/421
6,057,499 A * 5/2000 Basmadjian ..... 84/411 R
6,291,752 B1 * 9/2001 Vergara ..... 84/411 R

OTHER PUBLICATIONS

University of idaho Lionel Hamption School of Musical Percussion: Pedagogy-Drum Set.*
Pedagogy-Drum Set at the University of Idaho Lionel Hampton School of Music Percussion; Apr. 6, 2001.*
Trashy, Classy Music, Music Students Learn Their Art, Entertain Their Audiences In Garbage Can band; St. Paul Pioneer Pres Dec. 14, 1997.*

* cited by examiner

*Primary Examiner*—Jeffrey Donels
*Assistant Examiner*—Jianchun Qin
(74) *Attorney, Agent, or Firm*—Fay Sharpe LLP

(57) ABSTRACT

A musical drum having a tapered shell connecting to a bottom, the tapered shell having ribs. The shell has an opening opposite the bottom. The drum also contains a plurality of layered mounting blocks mounted on the outer surface of the shell. The drum also has a rim member surrounding the shell and adjustably mounted to the mounting blocks. A membrane is mounted on the rib member and covers the opening at the top of the shell. A plurality of legs are adjustably mounted to the shell. Handles can also be mounted to the shell.

14 Claims, 15 Drawing Sheets

MUSICAL DRUM

This application claims priority from Provisional Application No. 60/303,835 filed Jul. 9, 2001.

BACKGROUND OF THE INVENTION

This invention relates to musical percussion instruments, and more particularly to a percussion instrument having a unique and beneficial configuration and construction.

DESCRIPTION OF THE PRIOR ART

There are several classifications of percussion instruments, including those defined as membranophones and idiophones.

Drums in the form of membranophones, which may or may not be tunable to a fixed pitch, have existed for centuries in many cultures. They produce sounds through the vibration of a tensioned membrane stretched over a smooth cylindrical shell or bowl. Several categories of membranophones are struck with a stick or mallet on their "drum head" or "batter head" and examples include timpani, timbale, tom-tom, bass drum, snare drum, steel drum, and barrel drum. After being struck, the drumhead and the drum shell then vibrate together to produce the desired musical sound. If the shell has both ends closed, the air chamber inside the shell also vibrates sympathetically with the drumhead. The quality of sound is determined in part, by the overall structure of the instrument: the depth, composition and shape of the shell; the thickness, composition, tension, and diameter of the membrane(s); whether or not the side opposite the membrane that is struck is open or enclosed; the size of vent(s); and the fastening methods and placement of the component parts and any added structures, such as a base or brackets, during assembly. Any added structure changes the vibration characteristics of the drum shell.

Another classification of percussive instruments is the group known as idiophones. These instruments produce sounds through the vibration of their entire body. Their shape usually differs substantially from membranophones, but many are struck to be heard, such as the wood block, cymbal, triangle, or keyboard percussion instrument. Their shape and composition determines the vibration characteristics of the instrument.

Although a snare drum is classified as a membranophone, engaging the snares attached to the bottom "snare head" influences its timbre characteristics. The snare head and therefore the snares (resonators) vibrate sympathetically with the struck membrane, i.e., "batter head," to significantly expand the tonal dimension of sound produced.

The construction of the present invention attempts to similarly expand the tone color of the sound produced by substantially increasing shell vibration (resonation) and by reconfiguring selected characteristics of standard membranophones.

SUMMARY OF THE INVENTION

The present invention provides a musical percussive instrument that improves upon vibratory, timbre, and resonant characteristics of traditional drums.

In accordance with a basic aspect of the present invention, the sound produced incorporates the physics of both membranophone and idiophone construction.

In accordance with another aspect of the present invention, the batter head is of oversized diameter, overlapping the top of the drum shell opening.

In accordance with yet another aspect of the present invention, the interior and exterior of the drum shell is not smooth, but instead, is vertically ribbed.

In accordance with still another aspect of the present invention, the shell is not cylindrical, but instead, tapered. The diameter of the shell gradually decreases from the batter head down to the bottom of the instrument.

In accordance with another aspect of the present invention, the length of the walls of the shell is nearly one-fourth longer than the diameter of the top opening of the shell.

External hardware is preferably mounted to a mounting block, fashioned of appropriate compositional layers and of sufficient thickness and size to buffer and minimize the muting of tonal vibrations.

The bottom of the instrument, directly opposite from the batter head, is an integral component of the shell, comprised of the same material, and yet serves as a vibratory membrane. The bottom of the instrument, directly opposite the batter head, incorporates a vent hole.

The present invention advantageously provides a percussion instrument in which the timbre augments the sounds produced in a traditional five piece drum kit (bass drum, snare drum, floor tom-tom, two mounted tom-toms), and is suitable for orchestral and ensemble use.

The present invention incorporates in its construction two handles to assist in carrying the musical drum.

Overall, a preferred embodiment of this invention differs from traditional tom-toms or bass drums in that it utilizes an oversized head, elongated shell, tapered shell, metal shell, non-smooth shell, hardware mounting blocks, and incorporates a metal bottom with vent. The preferred embodiment of the invention compares with traditional tom-toms and bass drums in that it incorporates an indefinite pitch membrane that can be tuned, and is struck to be played. It is of similar head size and shell depth as the "long drum" (a type of bass drum), and sits upon three legs, however, the similarity ends there. This instrument's construction also differs substantially from other traditional membranophones such as congas, snare drums, timbale and timpani.

DESCRIPTION OF THE PREFERRED EMBODIMENT

Figure 1:
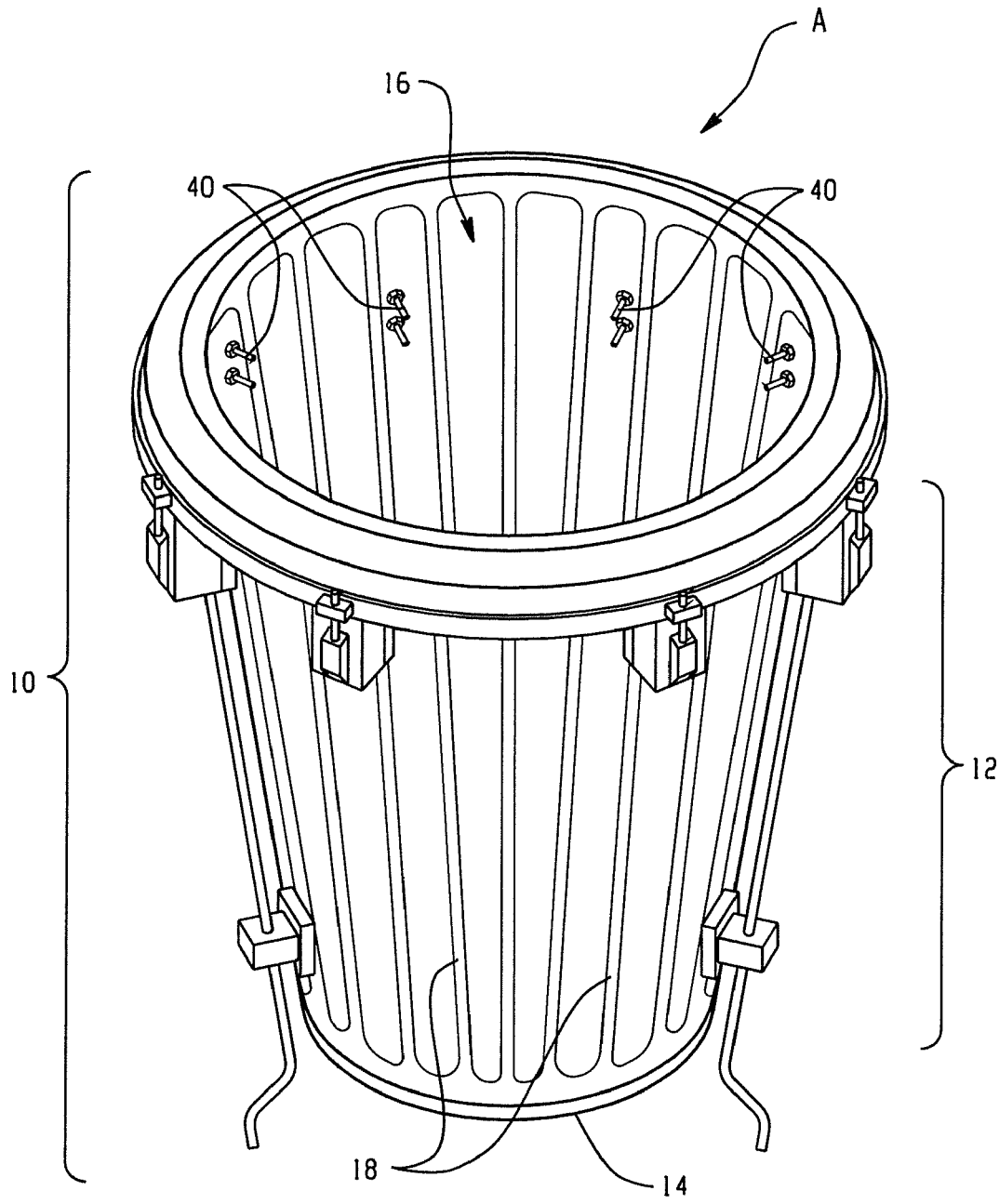
FIG. 1 is a perspective view of a drum in accordance with the present invention.

Referring now to FIG. 1, a musical drum A has a shell 10 including a wall 12 and an integral bottom or plate-like member 14. The references "upper" and "lower," and "top" and "bottom" are used for better understanding of the invention and with respect to the vertical, in view of the upright position of the drum. These terms cannot limit the scope of the invention as a function of the presentation thereof into space. The wall 12 of the shell is substantially circular in transverse cross-sectional shape, having a taper, gradually decreasing in diameter from a top opening 16 of the shell, towards the bottom 14 of the shell. The length of the wall is nearly one-fourth longer than the diameter of the top opening although actual length may vary due to tonal characteristics desired. The shell is constructed of galvanized steel, but also other materials could be selectively utilized for their resonant quality and extend over substantially the entire height of the shell. Vertical ribs or corrugates 18 are preferably spaced on the exterior of the wall at equal intervals around the periphery of the bottom. The length, depth, pattern and spacing of the ribs 18 can vary in actual construction, based on the resonant qualities of the materials used in shell construction.

Figure 2:
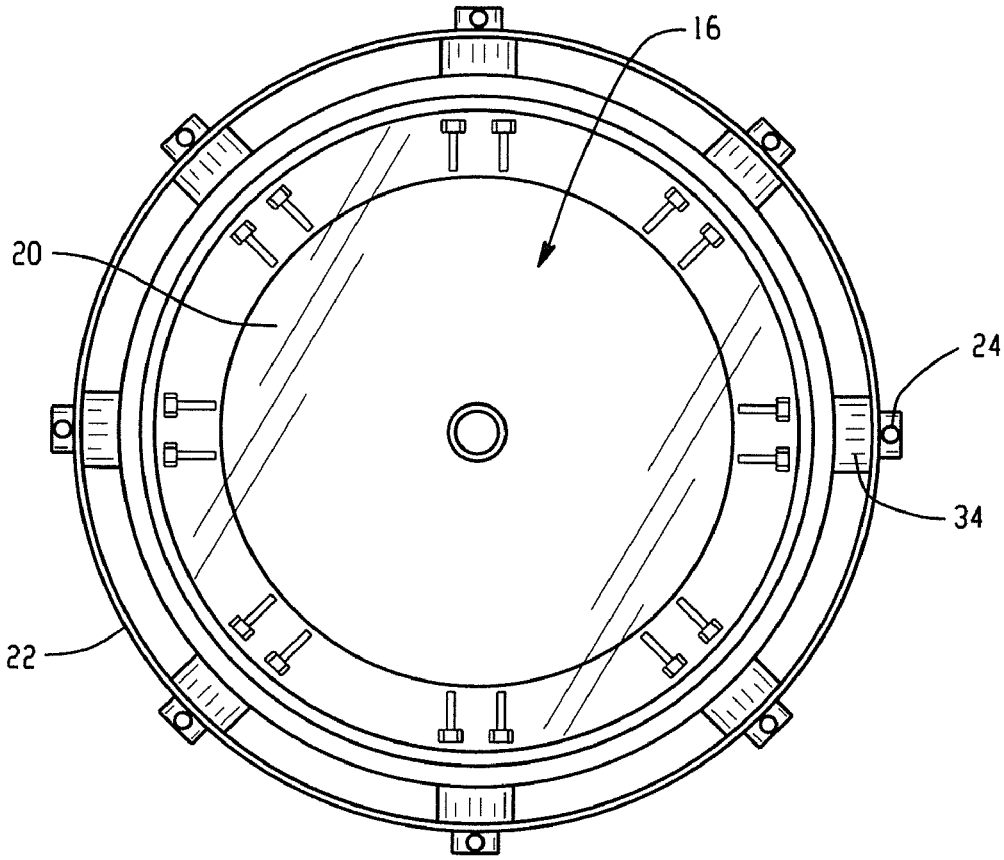
FIG. 2 is a top view showing the interior of the drum of FIG. 1.

FIG. 2 depicts a top view of the interior of the shell showing a batter head or membrane 20 that overlaps the top opening 16 of the shell. The batter head material can be selected for appropriate tonal qualities. The batter head 20 is preferably mounted on the shell using a metal hoop or rim 22. FIG. 2 also shows that the interior walls of the shell have a reversed indentation pattern of the ribbing or corrugates on the exterior, i.e., a corrugated pattern that extends over the substantial height of the shell.

Figure 3:
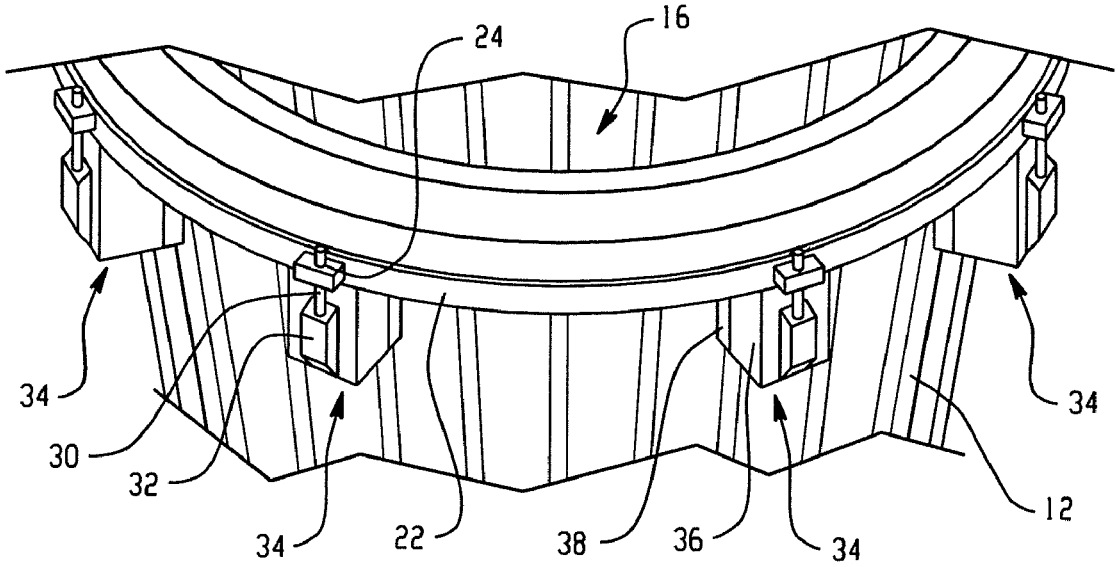
FIG. 3 is a side view having an enlarged detail of the upper construction of the drum of FIG. 1.

FIG. 3 also depicts the rim 22, having holes 24 equally spaced around the rim adapted to receive bolt type tension rods 30. The tension rods attach the rim to tension rod lugs or mounting brackets 32 that are fastened to the exterior of the wall 12 near the top opening 16. The drum is tuned to an indefinite pitch by tightening or loosening the tension rods as desired. Although a conventional rim and conventional tension rod hardware are depicted, they do not have to be used if a suitable substitution is found and as would be apparent to one skilled in the art.

Shown in FIG. 3, the lugs mount on multilayered mounting blocks 34. The mounting blocks have a wood block layer 36 and a thick rubber cushion 38 layer. Materials other than wood and rubber may instead be selected and incorporated into the construction of this instrument, the purpose of the multilayered mounting block being to buffer and minimize the muting of tonal vibrations. The rubber layer 38 is mounted onto the wall 12 and the wood layer 36 is mounted on the top of the rubber layer. The side of the wood block layer proximal to the wall is angled to conform to the taper of the wall to allow the side of the mounting block away from the wall to remain approximately perpendicular to the batter head. The tension rod lugs and multilayer mounting blocks can be fastened to the inside of the metal drum shell with a washer, bolt and nut assembly 40 as seen in FIG. 1.

Figure 4:
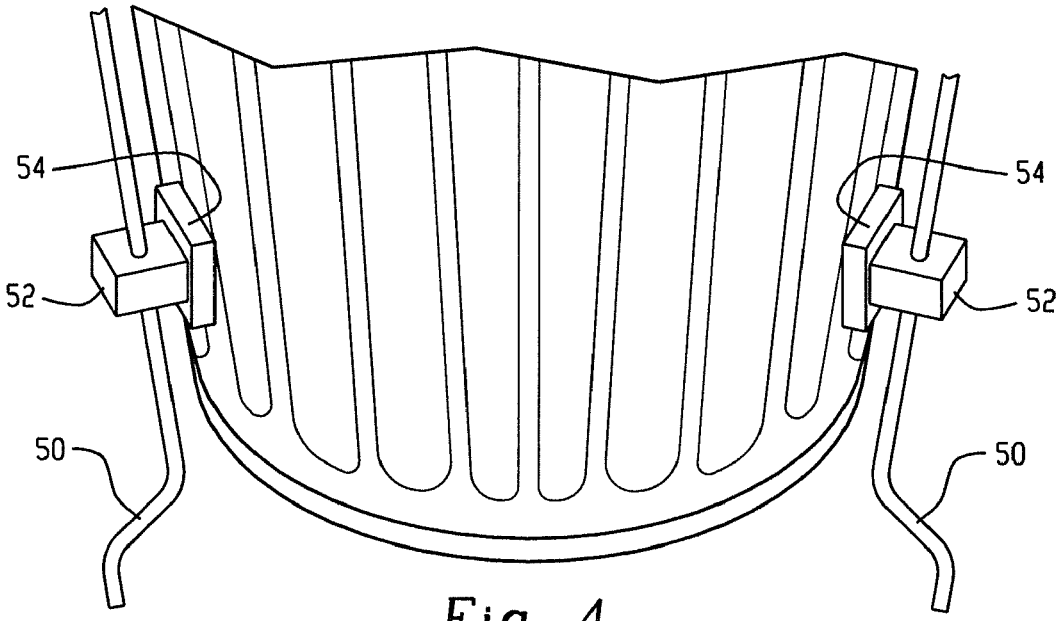
FIG. 4 is a side view having an enlarged detail of the lower construction of the drum of FIG. 1.

FIG. 4 depicts two of a plurality of legs 50 placed equidistantly around the periphery near the bottom of the shell. The legs are inserted into leg mounting casings 52, which allow for leg height adjustment. Note that standard leg hardware is depicted, however other suitable hardware can be substituted or other mounting methods can be used. The leg mounting casings are then mounted to a rubber mounting block 54. Again, materials other than rubber may be used, the purpose being to minimize the muting of tonal vibrations.

Handles 60 are preferably equidistantly placed on the periphery of the shell, near the top. The handles are placed in between multilayer mounting blocks. One metal handle 60 is depicted on FIG. 5, although the size, shape, composition and fastening method may vary.

Figure 5:
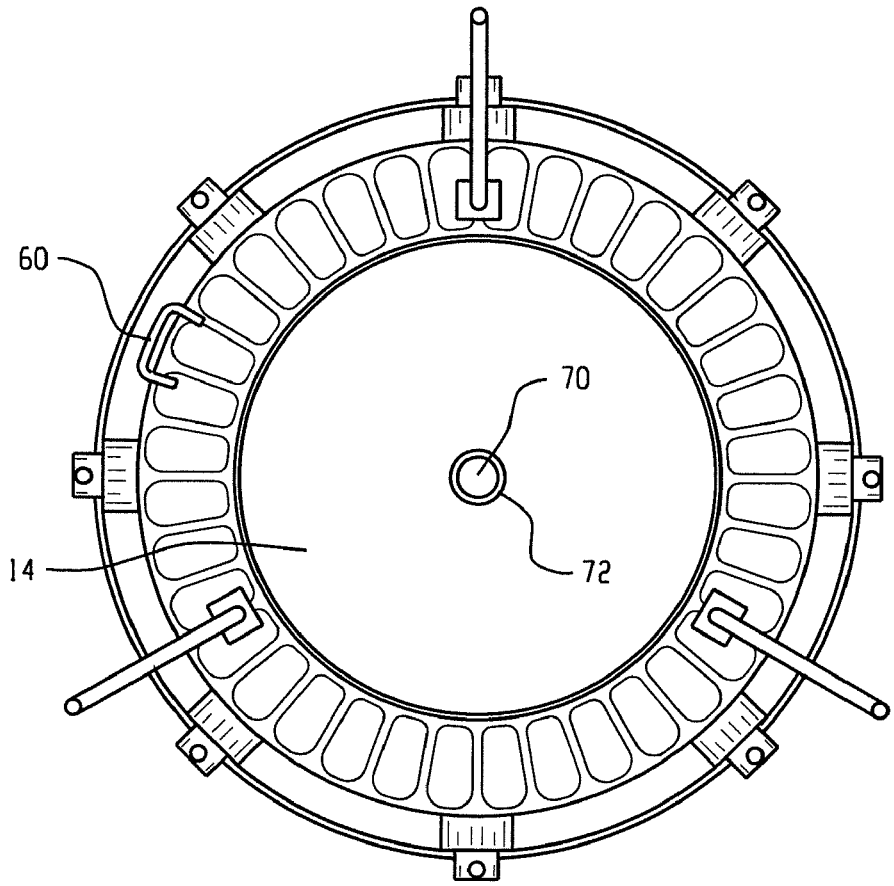
FIG. 5 is a bottom view of the drum of FIG. 1.
Figure 6:
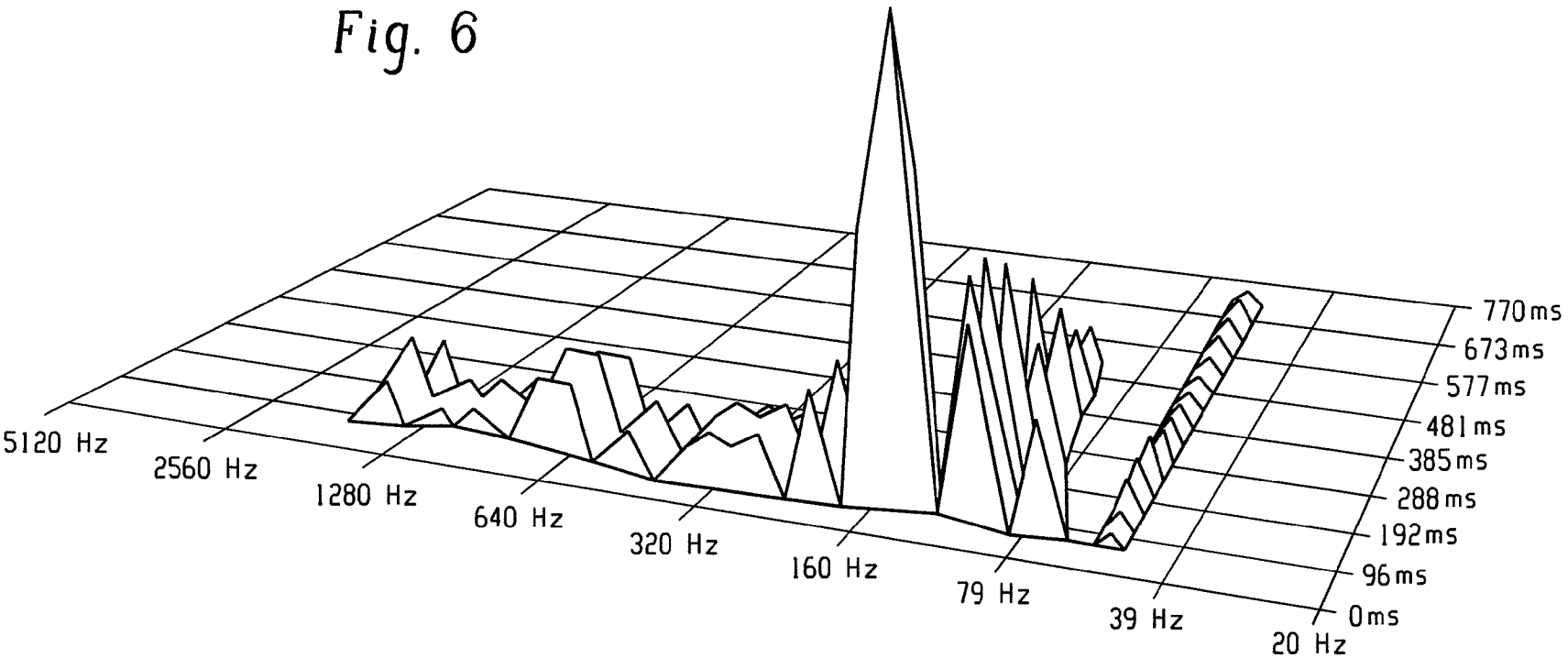
FIGS. 6-8 are frequency analyses of the inventive drum made using an Earthworks TC30K microphone with the microphone placed sixty six inches horizontal from the drum and twenty three inches off the floor.
Figure 7:
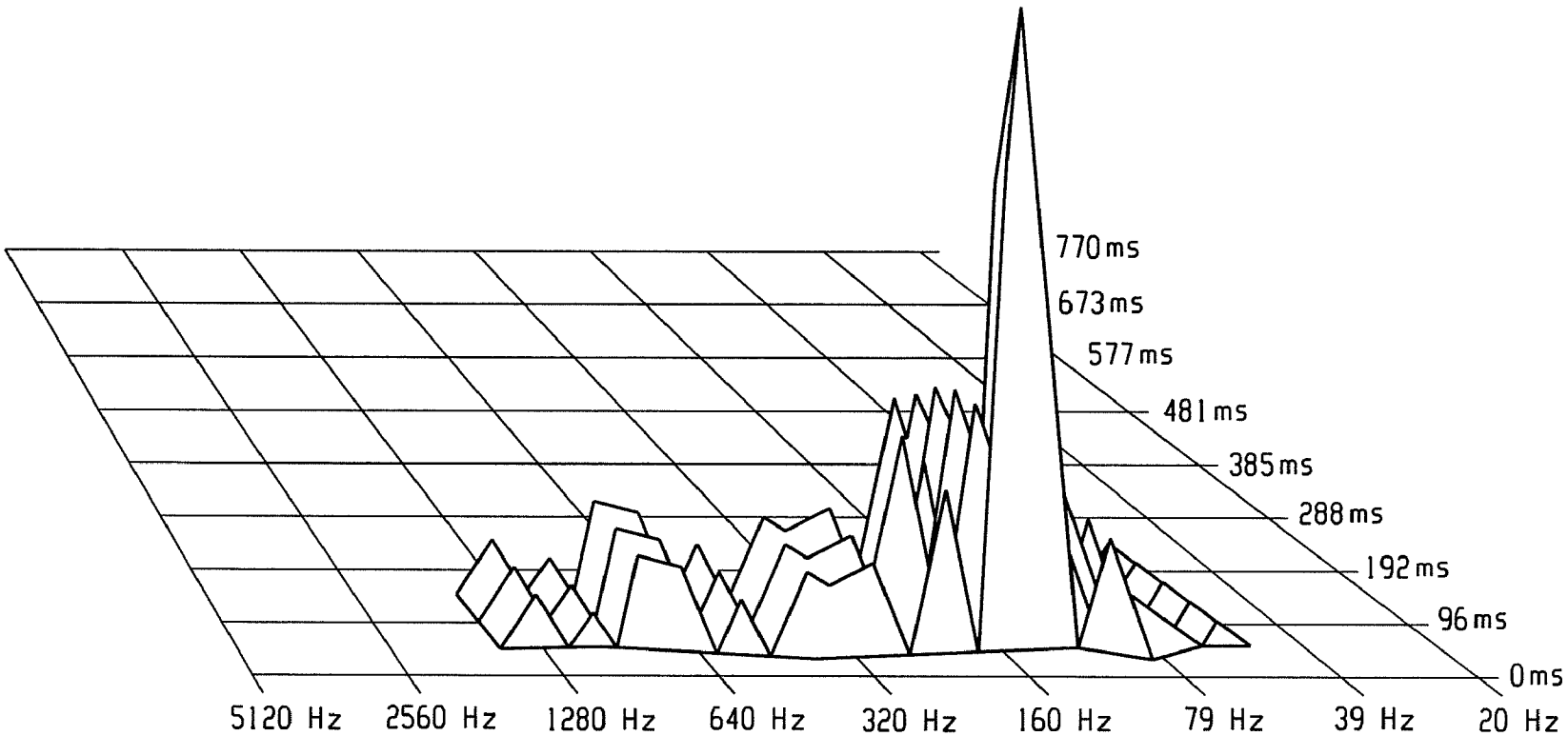
Figure 8:
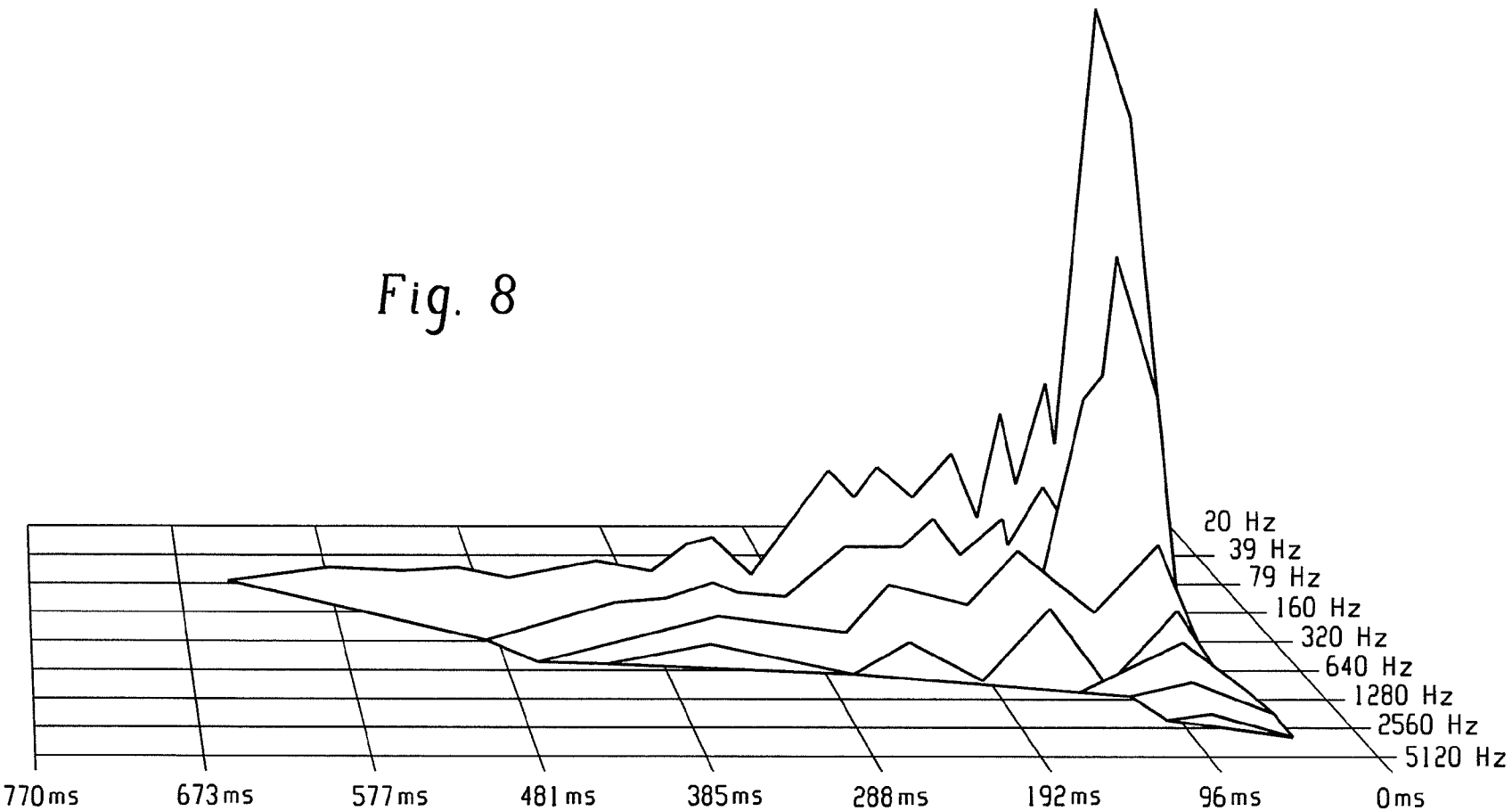
Figure 9:
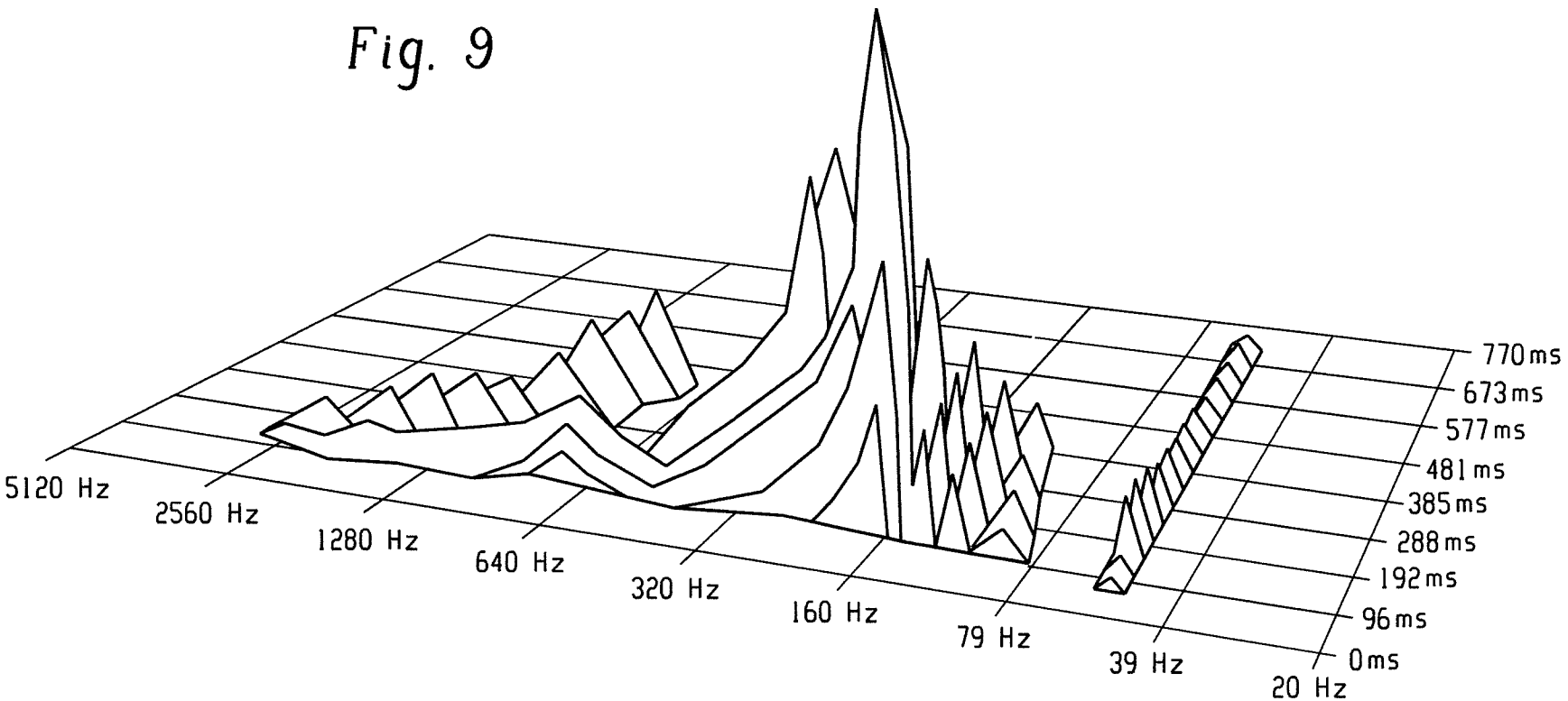
FIGS. 9-11 are frequency analyses of a Tama® 16 inch floor tom made using an Earthworks TC30K microphone with the microphone placed sixty six inches horizontal from the drum and twenty three inches off the floor.
Figure 10:
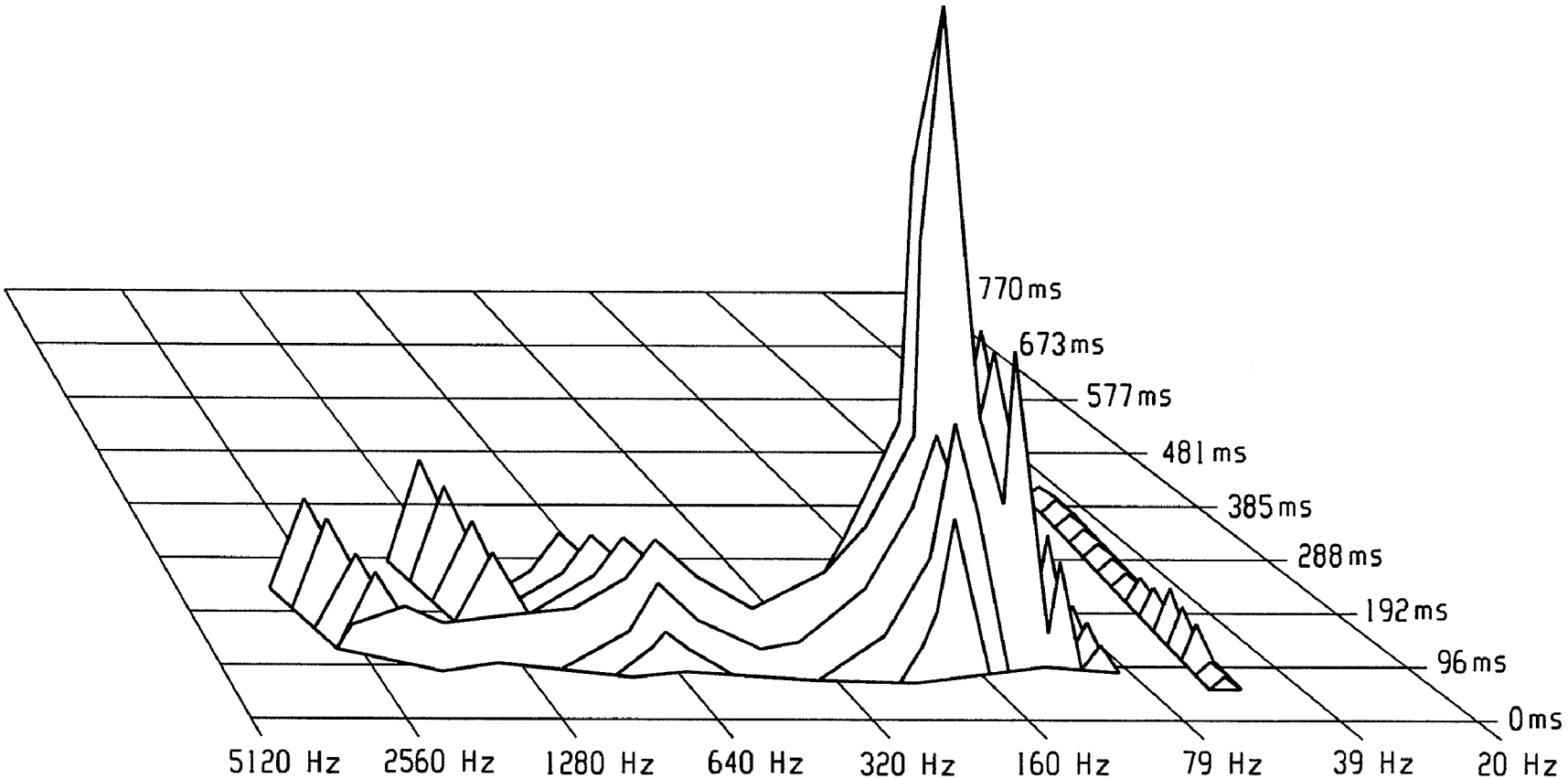
Figure 11:
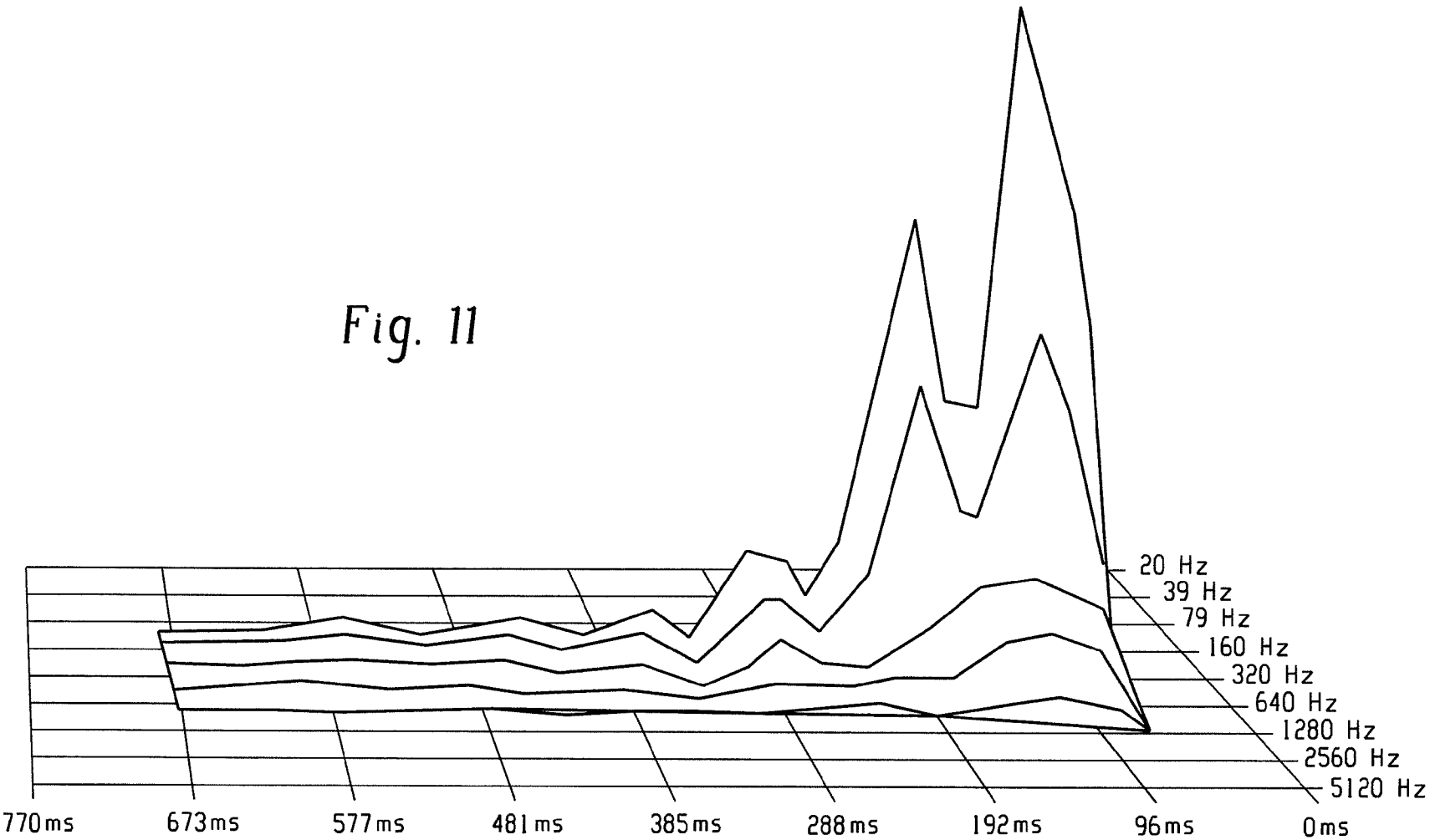
Figure 12:
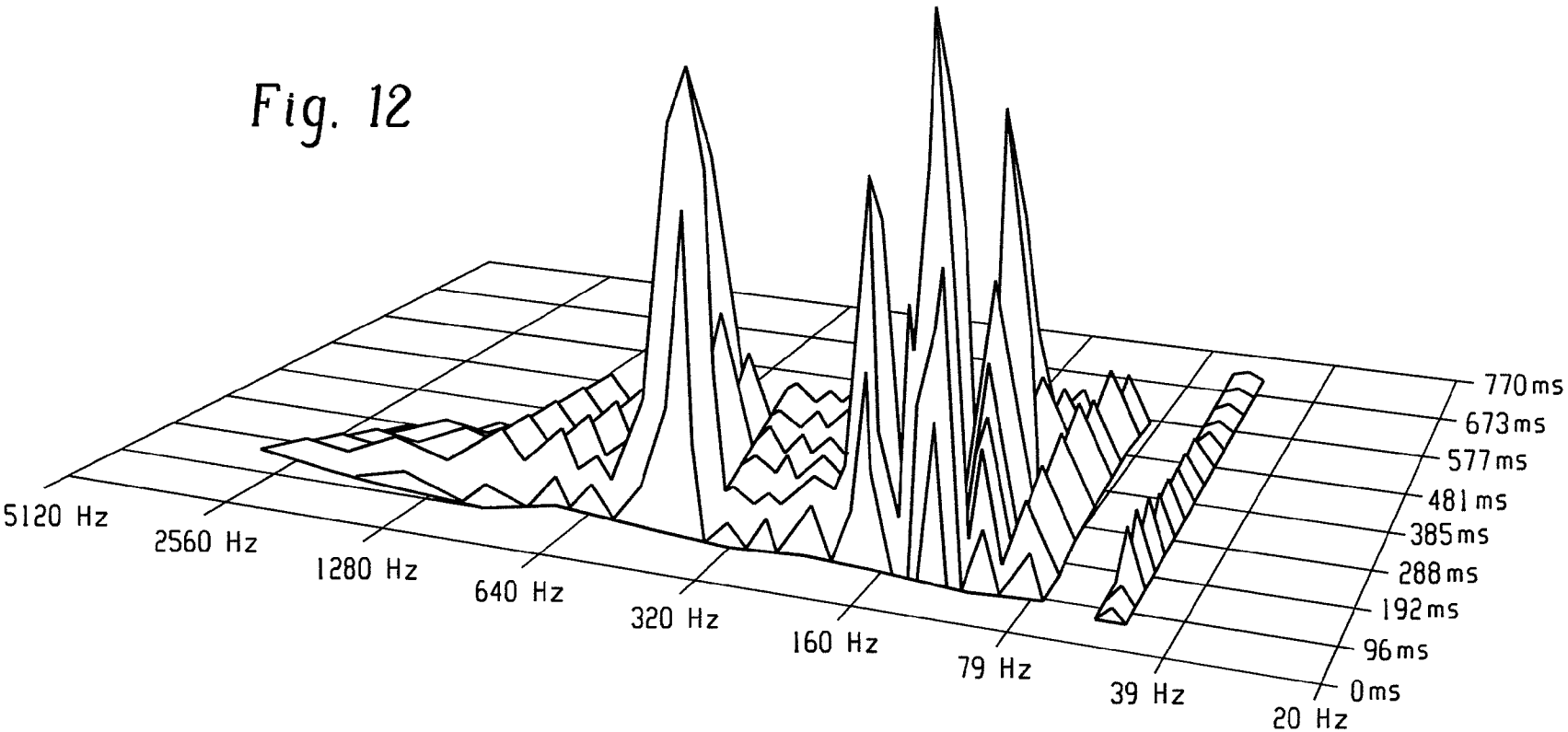
FIGS. 12-14 are frequency analyses of the inventive drum made using an Earthworks TC30K microphone with the microphone placed sixty five inches horizontal from the drum and seventy three inches off the floor.
Figure 13:
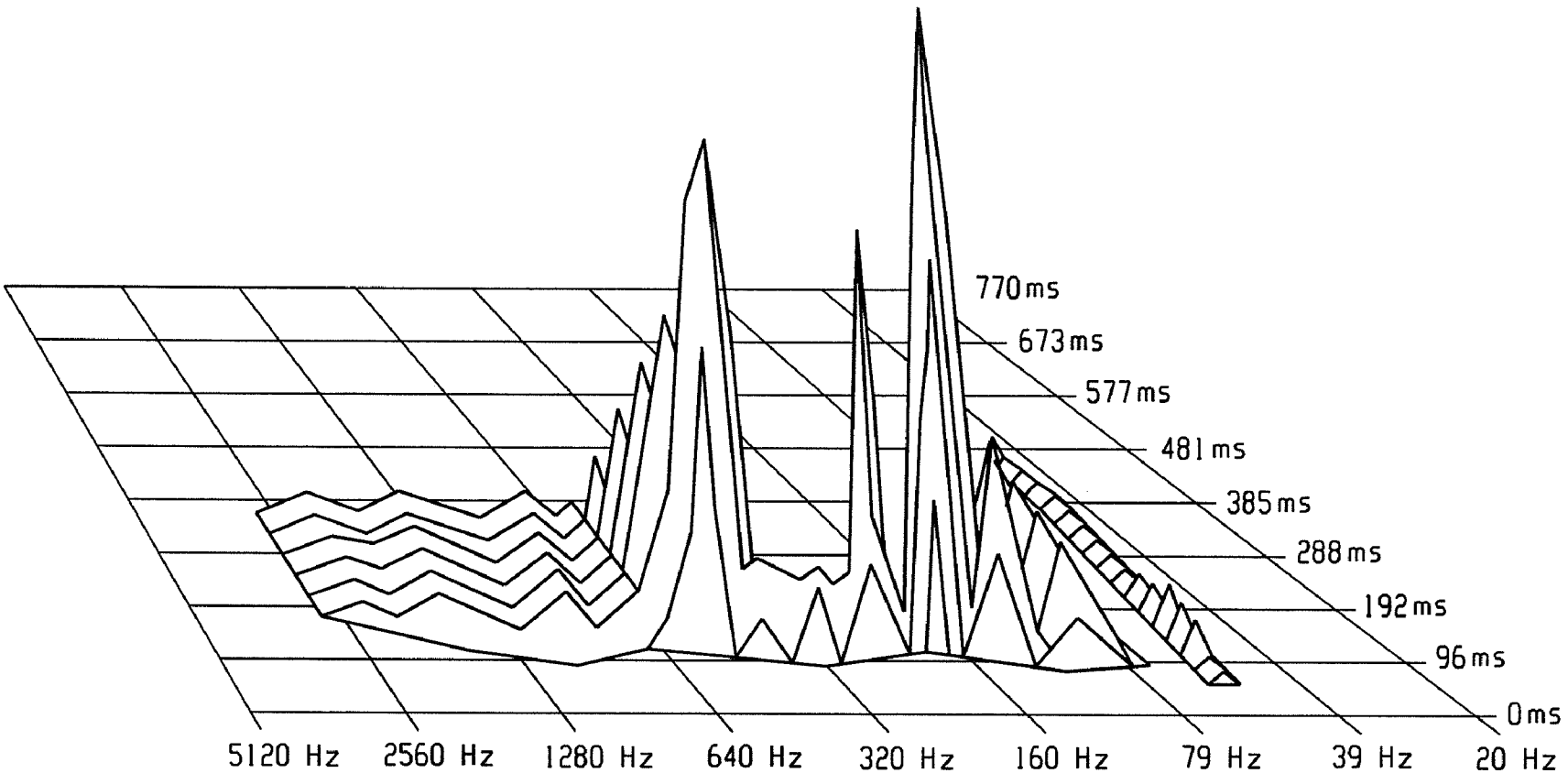
Figure 14:
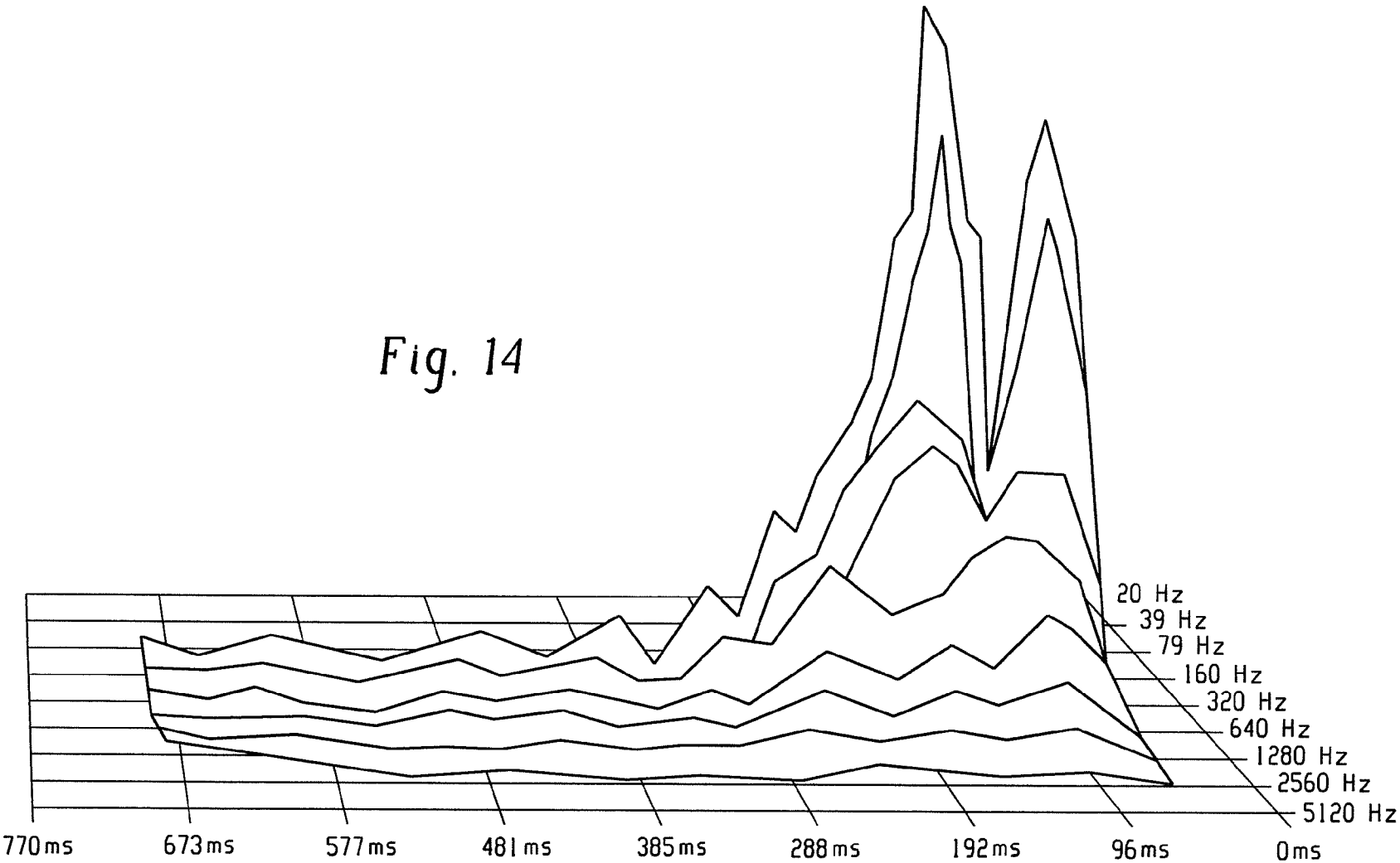
Figure 15:
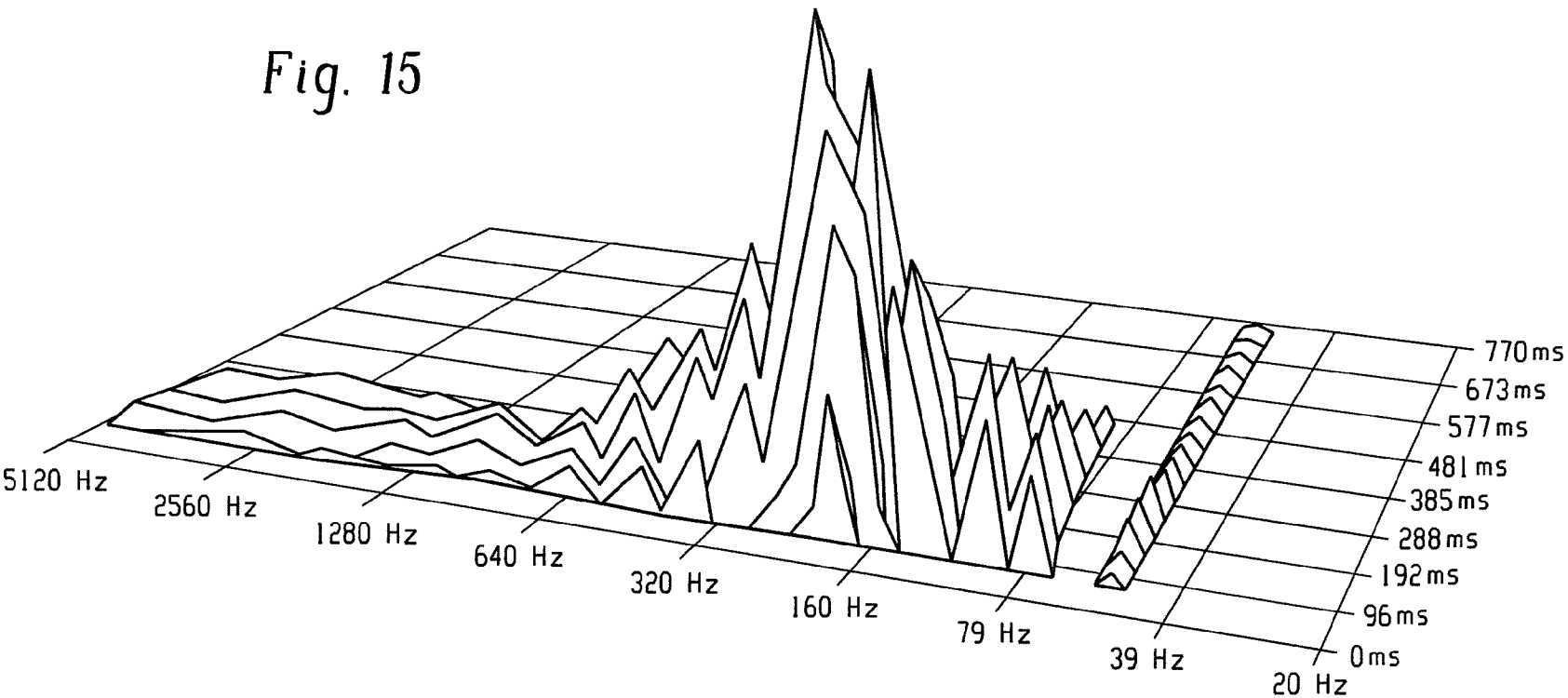
FIGS. 15-17 are frequency analyses of a Tama® 16 inch floor tom made using an Earthworks TC30K microphone with the microphone placed sixty five inches horizontal from the drum and seventy three inches off the floor.
Figure 16:
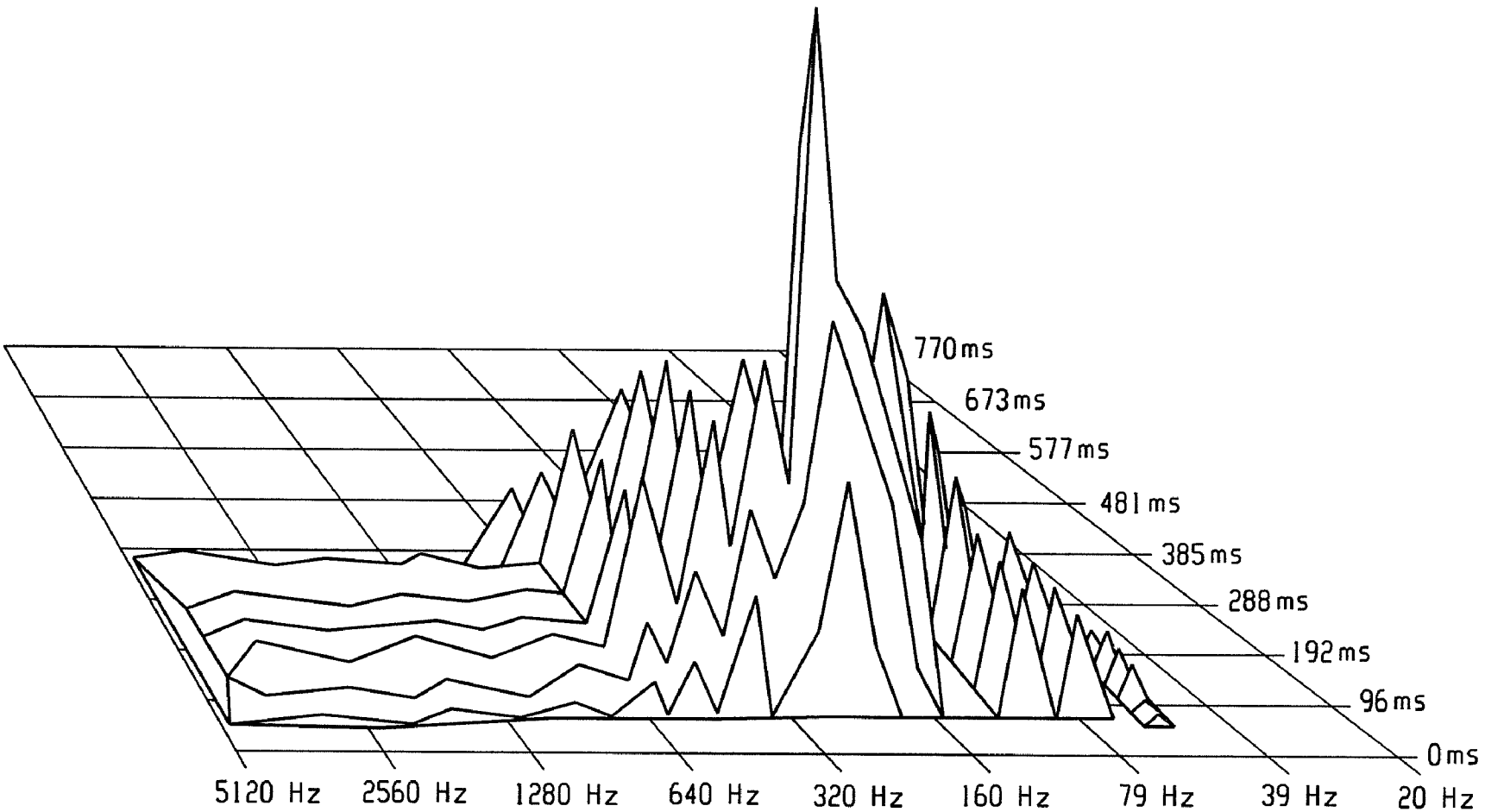
Figure 17:
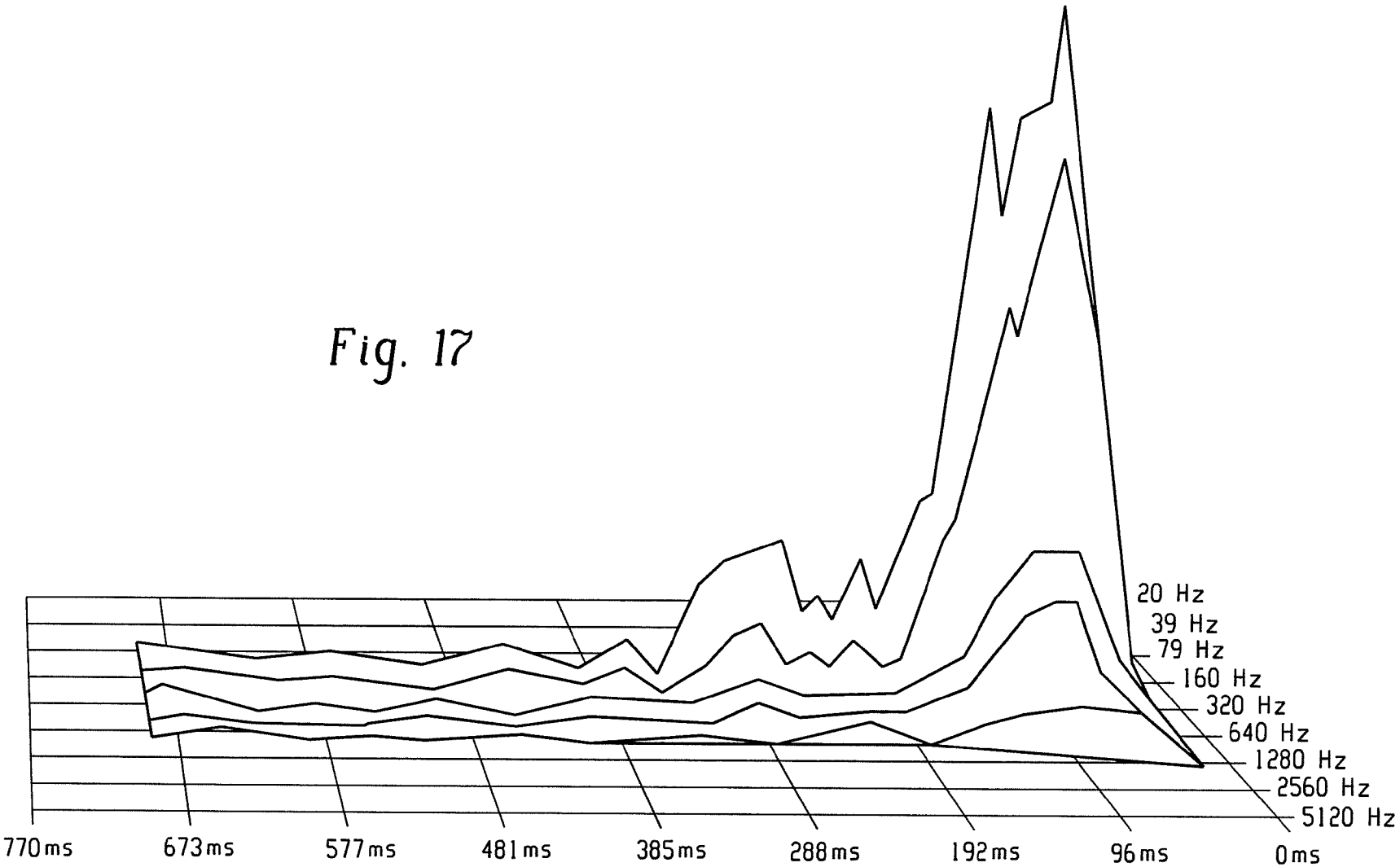

FIG. 5 shows the bottom of the shell 14 to be relatively flat, although some curvature may enhance the tonal quality of the instrument. The bottom may be crimped and/or brazed, welded or affixed to the wall of the shell in any suitable, permanent manner.

A vent hole 70 is shown in FIG. 5. Although the vent hole is depicted as being circular and quite small in relation to the diameter of the bottom of the shell, the actual diameter, shape, placement and number of vent holes may vary to optimize tonal characteristics. A rubber grommet lines 72 the hole, although other suitable material may be used in place of rubber. The vent hole is variable in that the diameter can be changed or modified.

FIGS. 6-17 are exemplary of a frequency analysis of the inventive drum having a twenty inch (20") batter head as compared to a commercially available Tama® 16" floor tom. As can be seen in the figures, when the inventive drum is struck, the sound produced has a multiple fundamental tone pattern as compared to the strong fundamental tone pattern produced by the commercially available drum.

The invention has been described with reference to a preferred embodiment. Obviously, modifications and alterations will occur to others upon a reading and understanding of the specification. All such modifications and alterations insofar as they come within the scope of the appended claims or the equivalents thereof are intended to be covered by the accompanying claims.

Having thus described the invention, what is claimed is:

1. A drum comprising:

a plate-like member having a vent hole extending therethrough;

a substantially annular wall having ribs circumferentially spaced along the wall and extending over substantially an entire height of the wall, the wall attached at a first end to the plate-like member;

a hoop member surrounding the wall and fastened to the annular wall at a second end of the wall; and a membrane covering the wall second end and mounted on the hoop member, wherein the annular wall has a tapering conformation over its length that increases from the plate-like member at the first end to the membrane at the second end.

2. A drum according to claim 1 wherein the plate-like member is integrally formed with the annular wall and the vent hole is circular.

3. A drum according to claim 1 wherein the wall is nearly one-fourth longer than the diameter of the opening.

4. A drum according to claim 1 wherein the wall surrounds a peripheral edge of the plate-like member.

5. A drum according to claim 1 wherein the wall defines an opening having a diameter larger than the plate-like member and positioned opposite the plate-like member.

6. A drum according to claim 5 wherein the hoop member has a diameter at least as large as the opening.

7. A drum according to claim 5 wherein a perpendicular distance between the opening and the hoop member is adjustable.

8. A drum according to claim 1 further comprising mounting blocks attached to the wall.

9. A drum according to claim 8 wherein the mounting blocks comprise a first layer mounted on the wall and a second layer mounted on the first layer.

10. A drum according to claim 9 wherein the first layer is rubber and the second layer is wood.

11. A drum according to claim 1 further comprising lugs mounted on the wall.

12. A drum according to claim 11 wherein the lugs are mounted on the mounting blocks.

13. A drum according to claim 1 further comprising legs extending outwardly from the wall.

14. A drum comprising:

a plate-like member having a vent hole extending therethrough;

a substantially annular wall having ribs circumferentially spaced along the wall and extending over substantially an entire height of the wall, the wall attached at a first end to the plate-like member, wherein the annular wall has a tapering conformation over its length that increases from the plate-like member at the first end to the membrane at the second end and the mounting blocks are contoured to mate with the tapering conformation of the annular wall;

mounting blocks attached to the wall, the mounting blocks comprising a first layer mounted on the wall and a second layer mounted on the first layer;

a hoop member surrounding the wall and fastened to the annular wall at a second end of the wall; and a membrane covering the wall second end and mounted on the hoop member.

* * * * *